US010777923B2

(12) United States Patent
Cao et al.

(10) Patent No.: US 10,777,923 B2
(45) Date of Patent: Sep. 15, 2020

(54) ELECTRICAL ADAPTOR AND METHOD MAKIKNG THE SAME

(71) Applicants: FU DING PRECISION INDUSTRIAL (ZHENGZHOU) CO., LTD., Zhengzhou (CN); FOXCONN INTERCONNECT TECHNOLOGY LIMITED, Grand Cayman (KY)

(72) Inventors: Qin-Xin Cao, Kunshan (CN); Yen-Chih Chang, New Taipei (TW); Shou-Qiang Li, Kunshan (CN); Yu-Ke Chen, Kunshan (CN); Shih-Wei Hsiao, New Taipei (TW)

(73) Assignees: FU DING PRECISION INDUSTRIAL (ZHENGZHOU) CO., LTD., Zhengzhou (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/653,946

(22) Filed: Oct. 15, 2019

(65) Prior Publication Data

US 2020/0119475 A1 Apr. 16, 2020

(30) Foreign Application Priority Data

Oct. 15, 2018 (CN) ..... 2018 1 1196932

(51) Int. Cl.
*H01R 12/00* (2006.01)
*H01R 12/71* (2011.01)
(Continued)

(52) U.S. Cl.
CPC ..... *H01R 12/716* (2013.01); *H01R 12/7005* (2013.01); *H01R 12/73* (2013.01);
(Continued)

(58) Field of Classification Search
CPC .... H01R 23/7068; H01R 27/00; H01R 31/06; H01R 23/725; H05K 1/14
(Continued)

(56) References Cited

U.S. PATENT DOCUMENTS 4,718,857 A * 1/1988 Noschese ..... H01R 13/6275 439/292
5,761,050 A * 6/1998 Archer ..... H01R 12/585 361/744
(Continued)

FOREIGN PATENT DOCUMENTS

CN 206697657 U 12/2017
CN 207925768 9/2018

*Primary Examiner* — Phuong Chi Thi Nguyen
(74) *Attorney, Agent, or Firm* — Wei Te Chung; Ming Chieh Chang

(57) ABSTRACT

A hermetic electrical adaptor includes an insulative housing and a plurality of contacts retained therein. The housing includes a base having opposite first and second surface in a vertical direction, and a set of first side walls extending from the first surface to form a first mating cavity. Each contact includes a retention section extending through the base, a first extending section located in the first mating cavity and including a first bending section. The set of first side walls forms, adjacent to the first surface, a first recess communicating with the first mating cavity so as to expose a portion of the first extending section in the first recess. A waterproof glue occupies the first recess and a bottom portion of the first mating cavity so as to surround the exposed portions of the first extending sections of the contact for assuring sealing of the adaptor.

20 Claims, 18 Drawing Sheets

(51) Int. Cl.

| | |
|---|---|
| ***H01R 12/70*** | (2011.01) |
| ***H01R 12/73*** | (2011.01) |
| ***H01R 13/26*** | (2006.01) |
| ***H01R 13/405*** | (2006.01) |
| ***H01R 13/6585*** | (2011.01) |

(52) U.S. Cl.
CPC ..... *H01R 13/26* (2013.01); *H01R 13/405* (2013.01); *H01R 13/6585* (2013.01)

(58) Field of Classification Search
USPC ..... 439/59, 218, 61, 502, 631
See application file for complete search history.

(56) References Cited

U.S. PATENT DOCUMENTS

| | | | | |
|---|---|---|---|---|
| 6,561,821 | B1 | 5/2003 | Hai | |
| 6,695,622 | B2 * | 2/2004 | Korsunsky | H01R 31/06 439/631 |
| 2005/0170700 | A1 * | 8/2005 | Shuey | H01R 13/6477 439/701 |
| 2012/0178278 | A1 * | 7/2012 | Yokoo | H01R 12/775 439/345 |

* cited by examiner

ELECTRICAL ADAPTOR AND METHOD MAKIKNG THE SAME

BACKGROUND OF THE INVENTION

1. Field of the Invention

The present invention relates generally to an electrical adaptor having two opposite mating cavities for connecting two opposite plug connectors having the similar mating tongues, and particularly to the hermetic electrical adaptor.

2. Description of Related Arts

China Utility Patent No. CN207572564U discloses a pair of board-to-board connectors having complementary mating interfaces for mating with each other and respectively mounted upon two opposite printed circuit boards (PCBs) for electrically connecting these two PCBs. Anyhow, in some situations it requires to have an adaptor connecting two opposite connectors having the similar mating interface.

It is desirable to provide an electrical adaptor for connecting two electrical connector having the similar mating tongues, and particularly to provide a hermetic electrical adaptor so as not to affect the in-and-out signal transmission.

SUMMARY OF THE INVENTION

An object of the invention is to provide a hermetic electrical adaptor including an insulative housing and a plurality of contacts retained therein. The housing includes a base having opposite first and second surface in a vertical direction, a set of first side walls extending from the first surface to form a first mating cavity, a set of second side walls extending from the second surface to form a second mating cavity opposite to the first mating cavity in the vertical direction. Each contact includes a retention section extending through the base, a first extending section located in the first mating cavity and including a first bending section. The set of first side walls forms, adjacent to the first surface, a first recess communicating with the first mating cavity so as to expose a portion of the first extending section in the first recess. A waterproof glue occupies the first recess and a bottom portion of the first mating cavity so as to surround the exposed portions of the first extending sections of the contact for assuring sealing of the adaptor above the first surface. The first recess extends through the set of first side walls in the transverse direction, and a covering device is attached upon an exterior surface of the adaptor to shield the first recess from an exterior so as to prevent contamination of the waterproof glue on the exterior surface of the adaptor. The set of second side walls may be optimally provided with a second recess, similar to the first recess, filled with the waterproof glue for the same purpose

DETAILED DESCRIPTION OF THE PREFERRED EMBODIMENT

Figure 1:
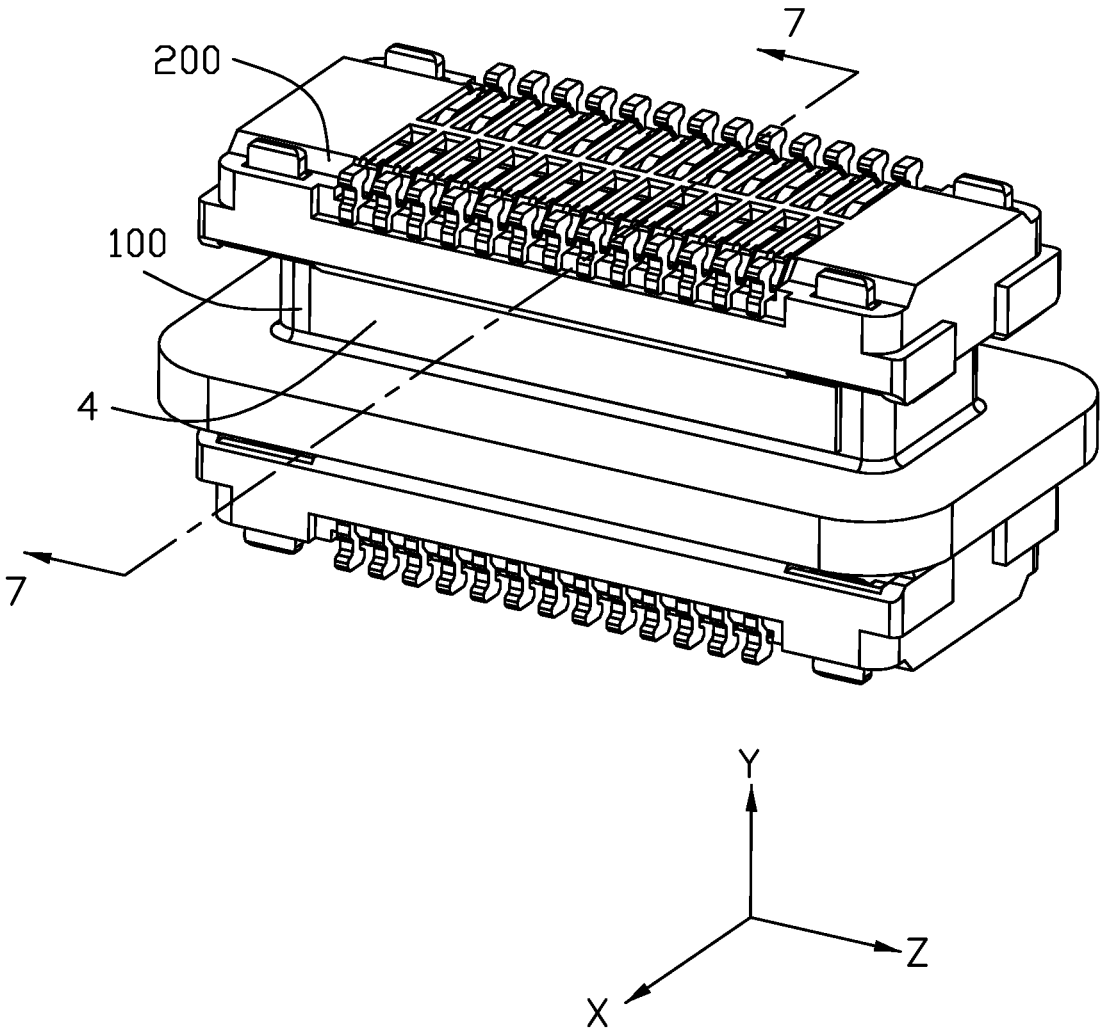
FIG. 1 is a perspective view of a hermetic electrical adaptor according to a first embodiment of the invention.
Figure 2:
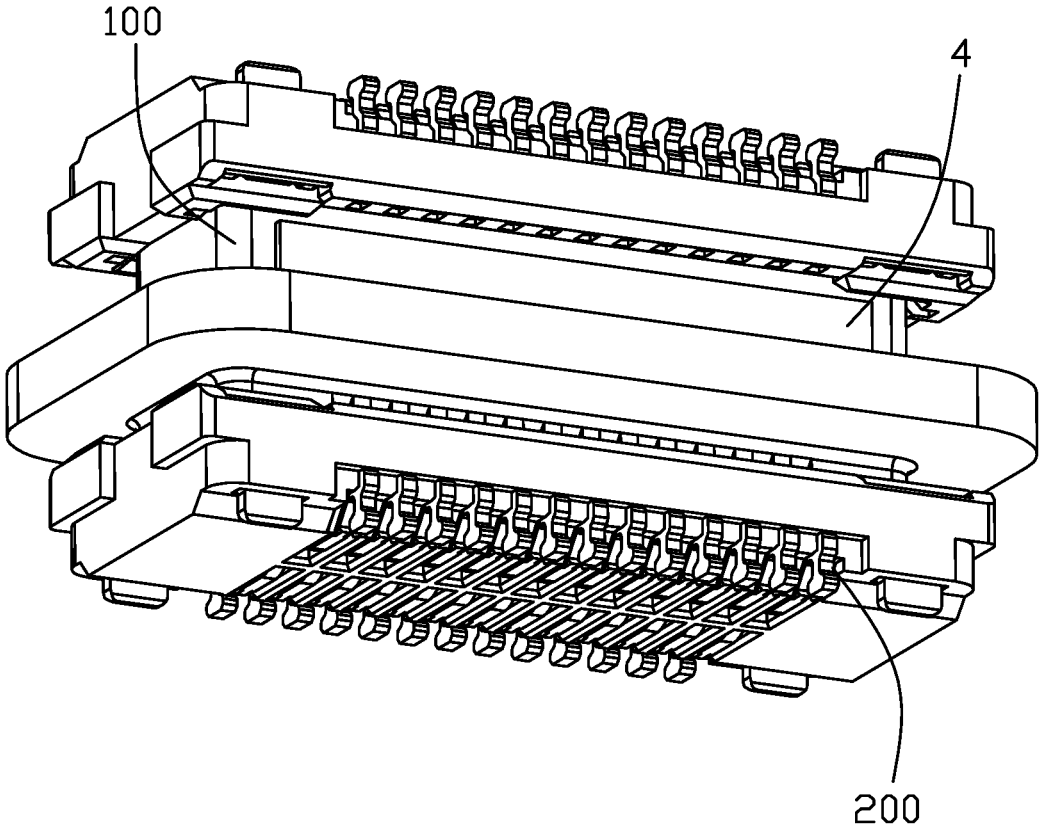
FIG. 2 is another perspective view of the hermetic electrical adaptor of FIG. 1.
Figure 3:
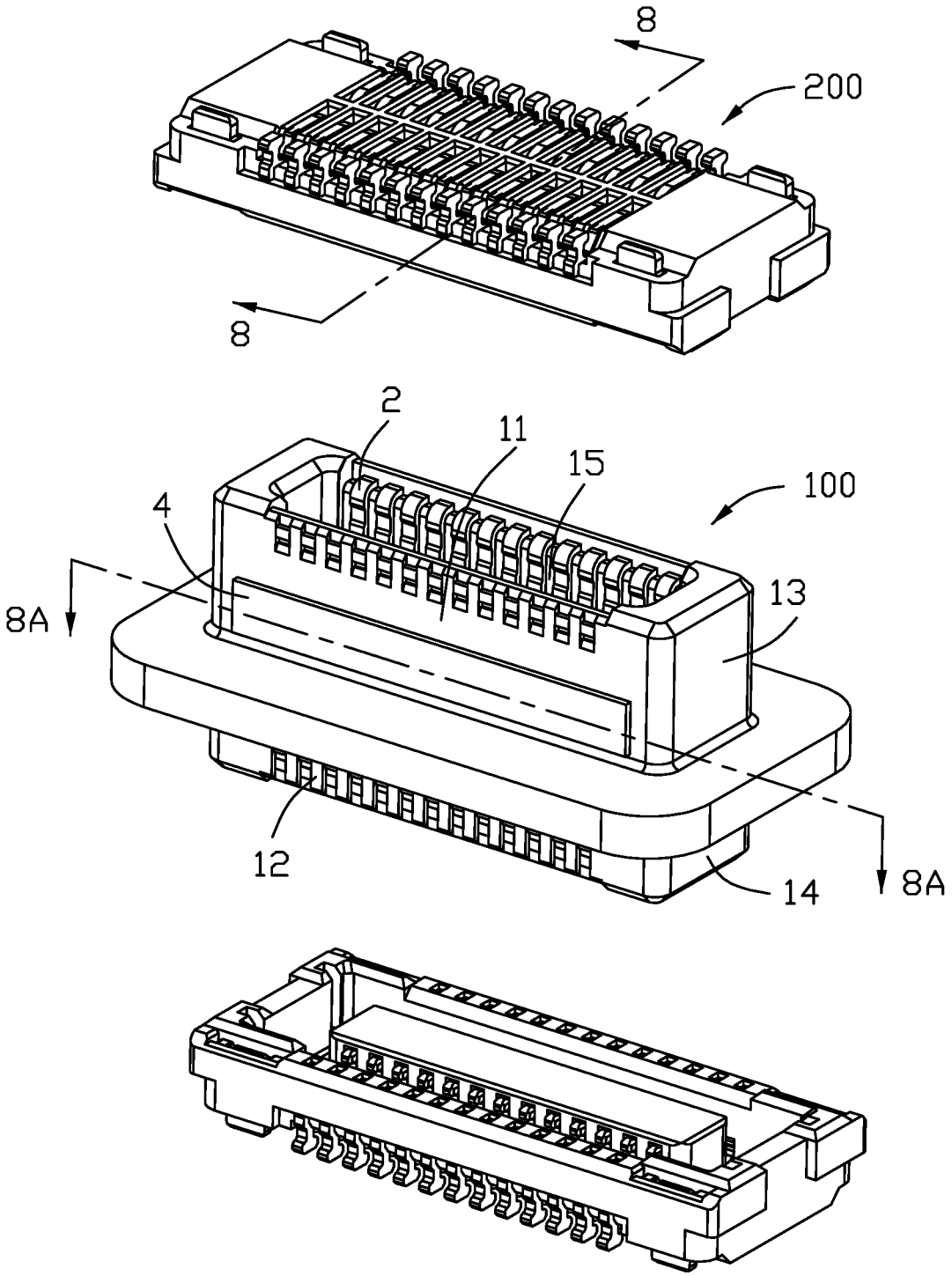
FIG. 3 is a perspective view of the hermetic electrical adaptor of FIG. 1 and the corresponding two mating connectors adapted to be mated therewith.
Figure 4:
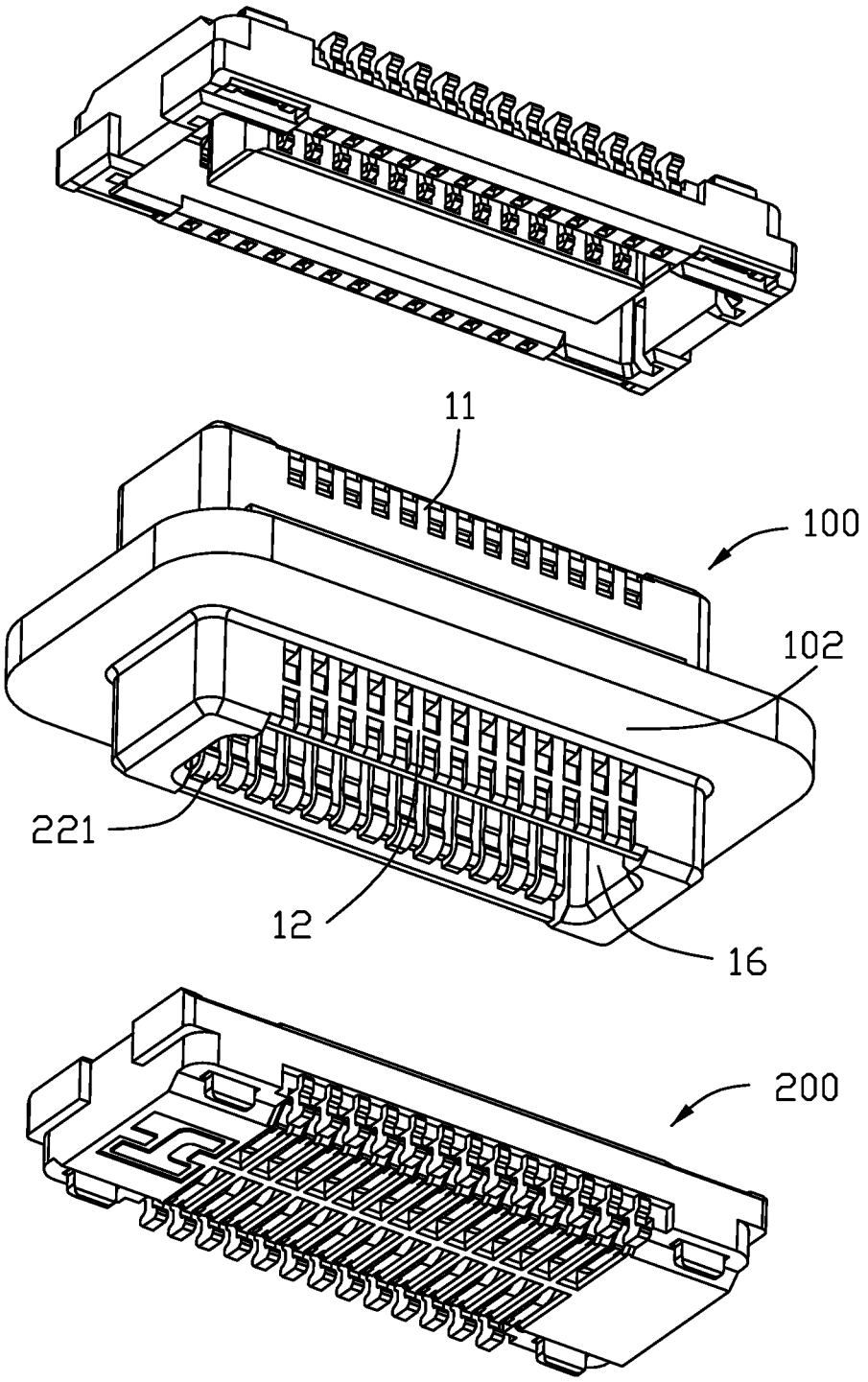
FIG. 4 another perspective view of the hermetic electrical adaptor of FIG. 1.
Figure 5:
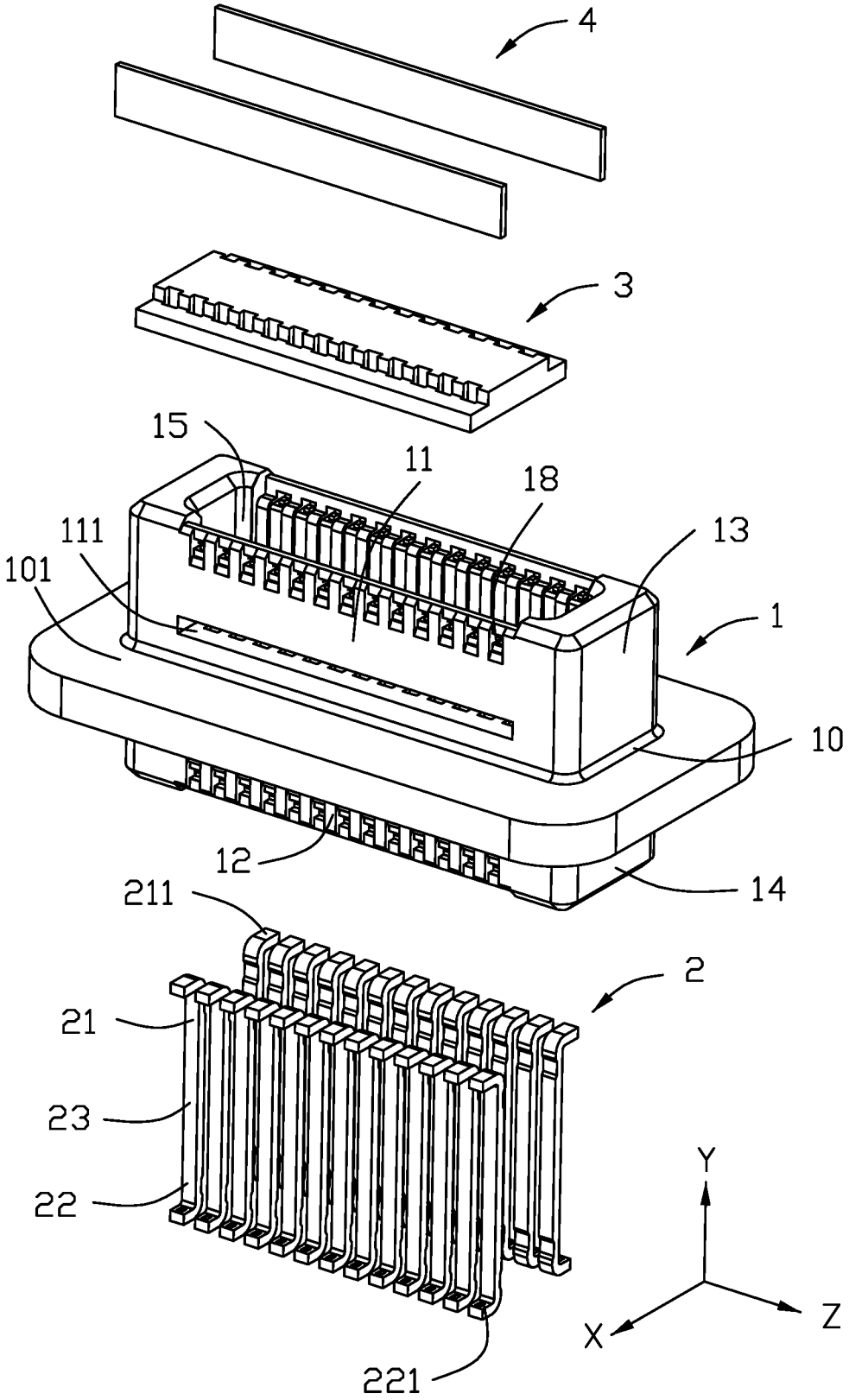
FIG. 5 is an exploded perspective view of the hermetic electrical adaptor of FIG. 1.
Figure 6:
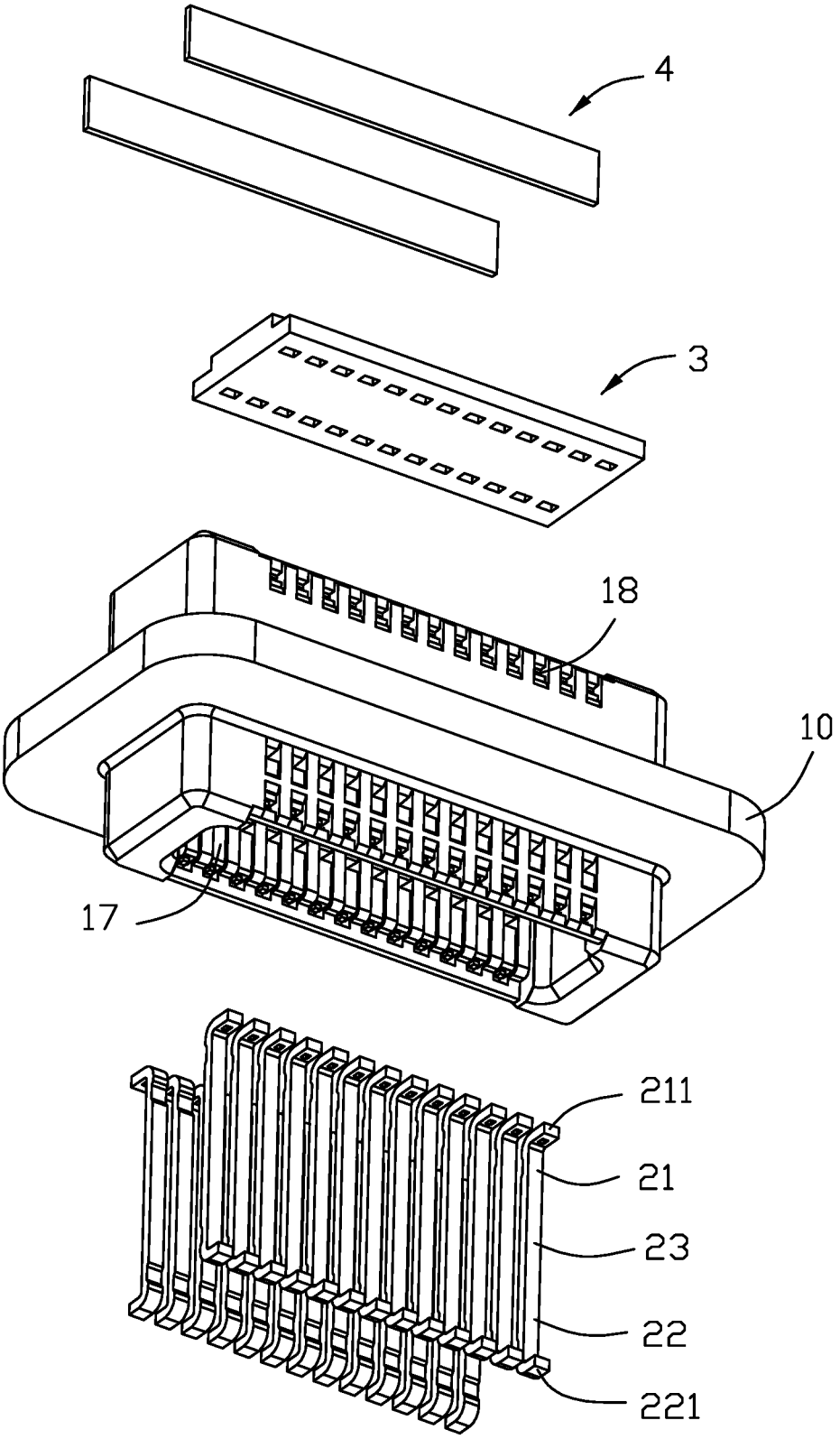
FIG. 6 is another exploded perspective view of the hermetic electrical adaptor of FIG. 5.
Figure 7:
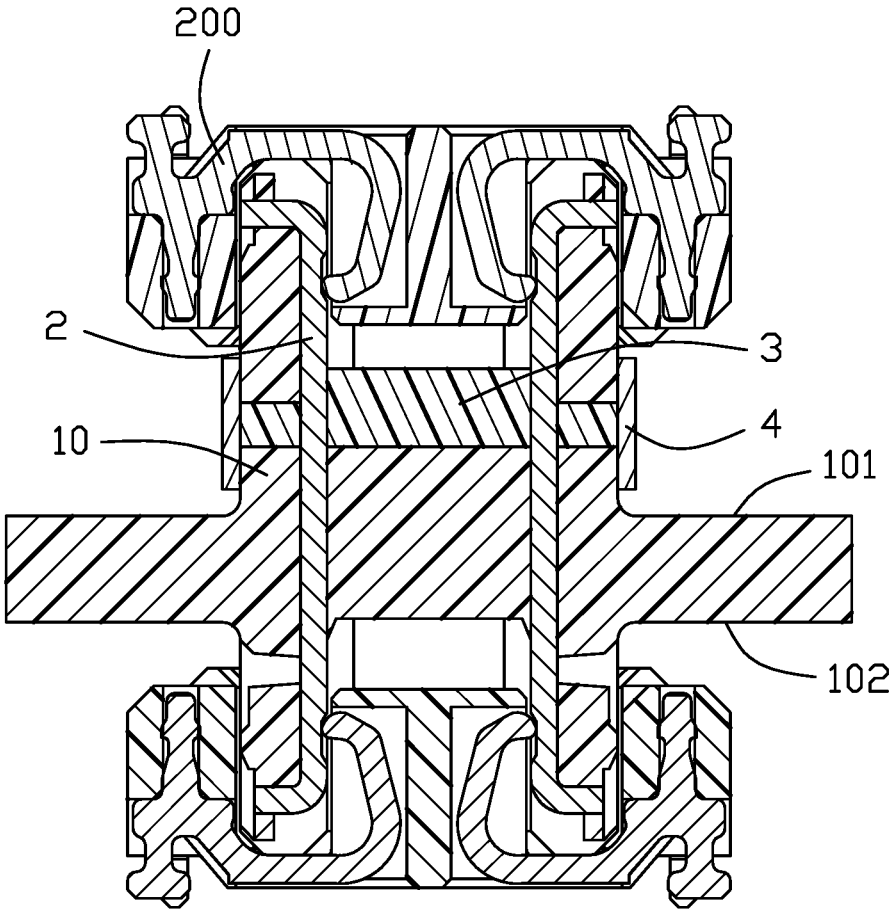
FIG. 7 is a cross-sectional view of the hermetic electrical adaptor and the two mated electrical connectors of FIG. 1.
Figure 8:
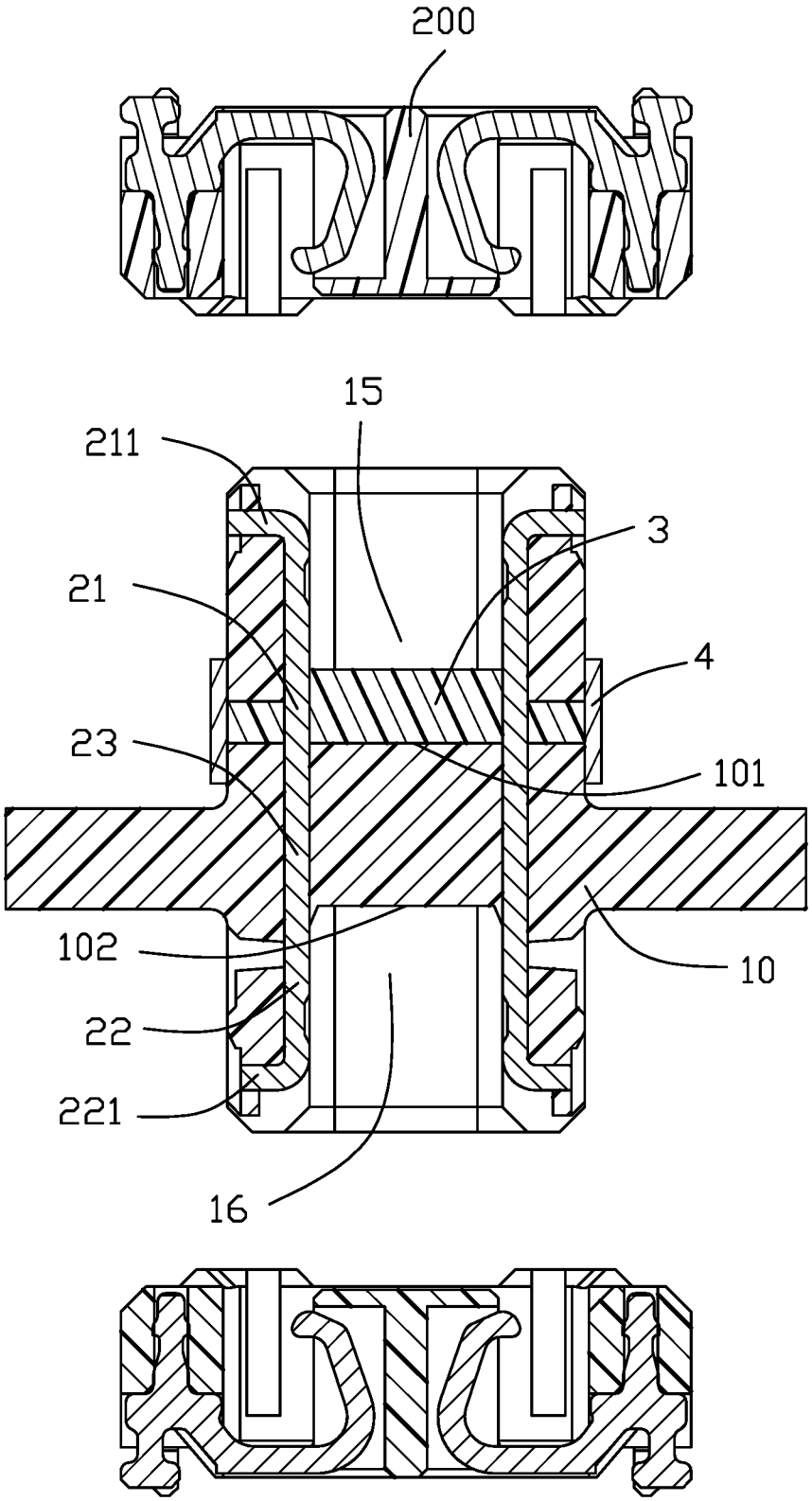
FIG. 8 is a cross-sectional view of the hermetic electrical adaptor and the two electrical connectors removed away from the adaptor of FIG. 3.
Figure 8A:
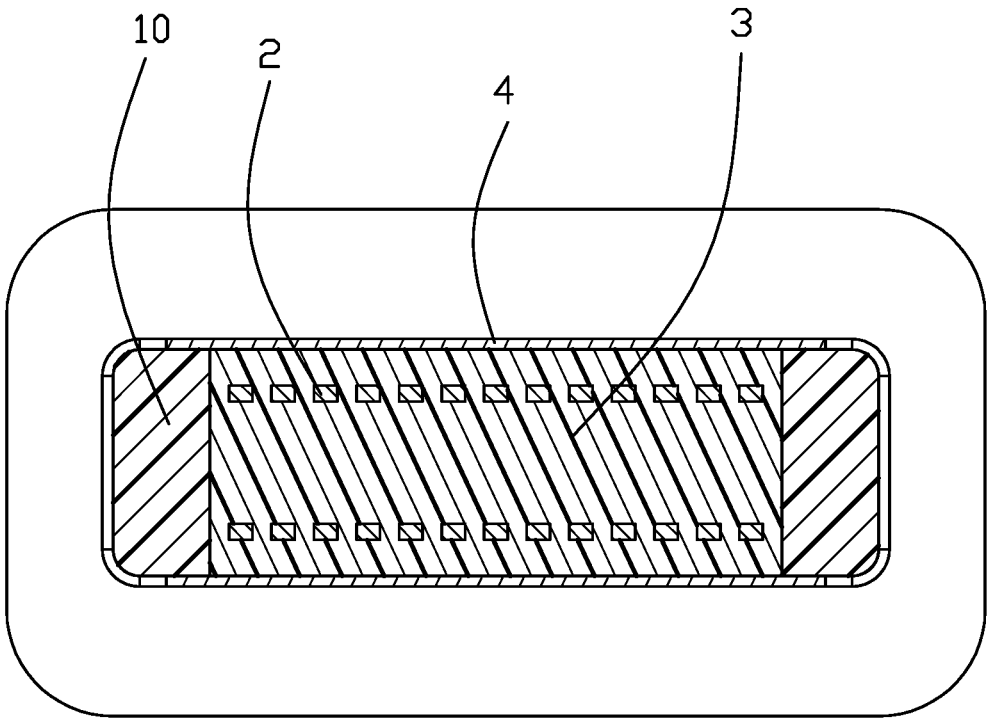
FIG. 8(A) is another cross-sectional view of the hermetical adaptor.

Referring to FIGS. 1-18, a hermetic electrical adaptor 100 for connecting two opposite mating connectors in the Y direction oppositely, includes an insulative housing 1, a plurality of contacts 2 retained in the housing 1, a waterproofing glue 3 inside the housing 1, and a covering device 4 shielding the waterproofing glue from an exterior.

The insulative housing 1 includes a base 10 with opposite first surface 101 and second surface 102. A set of first side walls 11 extend from the first surface 101 away from the base 10, and a set of second side walls 12 extend from the second surface 102 away from the base 10. A pair of first end walls 13 connect the set of first side walls 11, and a pair of second end walls 14 connect the set of second side walls 12. The set of first side walls 11 cooperates with the pair of first end walls 13 and the first surface 101 to commonly form a first mating cavity 15, and the set of second side walls 12 cooperates with the second end walls 14 and the second surface 102 to commonly form a second mating cavity 16. The first mating cavity 15 is isolated from the second mating cavity 16 by the base 10 in the Y direction. Notably, the set of first side walls 11 forms the first mating portion facing toward the first mating cavity 15, and the set of second side walls 12 forms the second mating portion facing toward the second mating cavity 16. Notably, the base 10 is dimensioned larger than the first mating portion and the second mating portion in both the X direction, i.e., the transverse direction, and the Z direction, i.e., the longitudinal direction which are perpendicular to each other and both are perpendicular to the Y direction, i.e., the vertical direction.

Referring to FIGS. 5-8, the set of first side walls 11 forms a first recess 111 along the X direction to communicate the first mating cavity 15 with an exterior in the X direction wherein the first recess 111 is slightly higher than the first surface 101, Similarly, the set of second side walls 12 is adapted to be optionally formed with the second recess (not shown), if necessary.

The contact 2 includes a first extending section 21 upon the set of first side wall 11 to face toward the first mating cavity 15, a retention section 23 extending through the base 10 along the Y direction, and a second extending section 22 upon the set of second side wall 12 to face toward the second mating cavity 16. The first extending section 21 includes a first bending section 211 and the second extending section 22 includes a second bending section 221. The set of first side walls 11 and the set of second side walls 12 form a plurality of inner passageways 17 to respectively receive the first extending sections 21 and the second extending sections 22, and further form a plurality of outer passageways 18 to respectively receive the first bending section 211 and the second bending section 221. Notably, all the first extending section 21, the retention section 23 and the second extending section 22 extend in the Y direction while both the first bending section 211 and the second bending section 221 extend in the X direction.

The first recess 111 communicates with the first mating cavity 15, and a portion of the first extending section 21 is essentially exposed in/toward the first recess 111. The covering device 4 is attached upon the set of first side walls 11 to shield the first recess 111 from the exterior so as to prevent contamination of the waterproofing glue 3 upon the exterior surface of the housing 1. In this embodiment, the covering device 4 is a strap secured upon the exterior surface of the set of first side walls 11. The fluidal glue 3 is poured into the first mating cavity 15 and enters into the first recess 111 without splitting due to the covering device 4, and successively solidified so as to stop humidity invasion along the vertical direction in the adaptor 100. In some applicable situation, the first mating portion is shielded by a shielding device and filled with the gas of Nitrogen. Understandably, such gas will not escape from the first mating cavity 15 to the second mating cavity 16 because of the hermetic structure derived from the waterproofing glue 3.

Optimally and similarly, a second recess may be optionally formed in the set of second side walls 12 and communicate with the second mating cavity 16 so as to have a portion of the second extending section 22 exposed in the second recess so as to have waterproofing glue filled within a bottom portion of the second mating cavity 16 adjacent to the second surface 102 and the second recess for enhancing the hermetical arrangement of the whole adaptor 100, i.e., both first mating cavity 15 and the second mating cavity 16 being waterproofing and hermetic.

The method of making the adaptor as shown in the embodiment, comprising the following steps: providing a plurality of contacts 2 each having a first extending section 21, a second extending section 22 and a retention section 23 therebetween; Integrally forming an insulative housing 1 with the contacts 2 via an insert-molding process wherein the housing 1 includes a base 10 with opposite first surface 101 and second surface 102, a set of first side walls 21 extending from the first surface 101 away from the base 10 to form a first mating cavity 15, and a set of second side walls 22 extending from the second surface 102 away from the base 10 to form a second mating cavity 16, the first extending section 21 disposed upon the set of first side walls 21, a first recess 111 formed in the set of first side wall 11 to expose a portion of the first extending section 21 therein; shielding the first recess 111 from an exterior with a covering device 4; and filling a bottom portion of the first mating cavity 15 adjacent to the first surface 101 and the first recess 111 with fluidal waterproofing glue 3 and having said glue 3 solidified.

Figure 9:
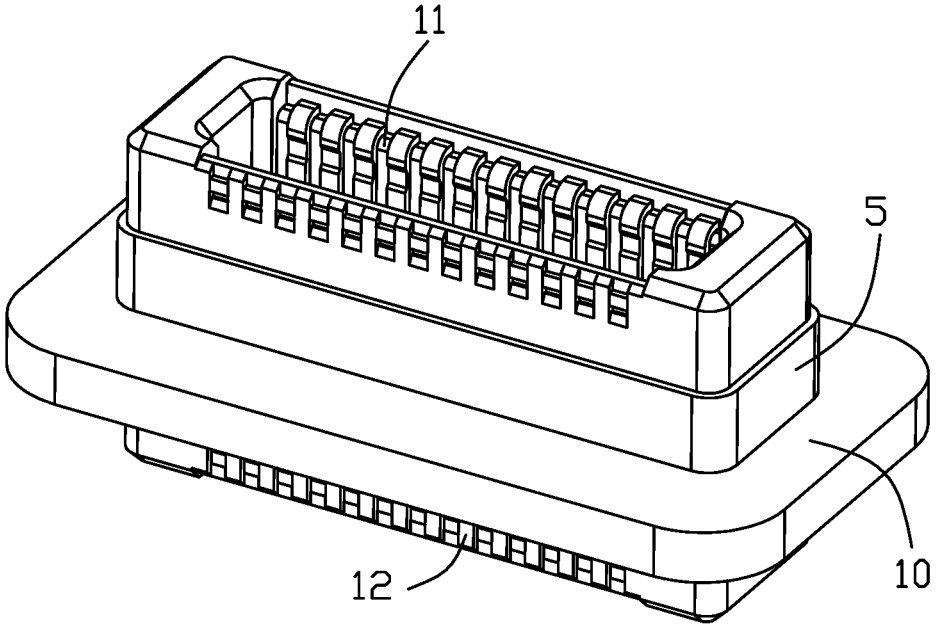
FIG. 9 is a perspective view of the hermetic electrical adaptor according to the second embodiment of the invention.
Figure 10:
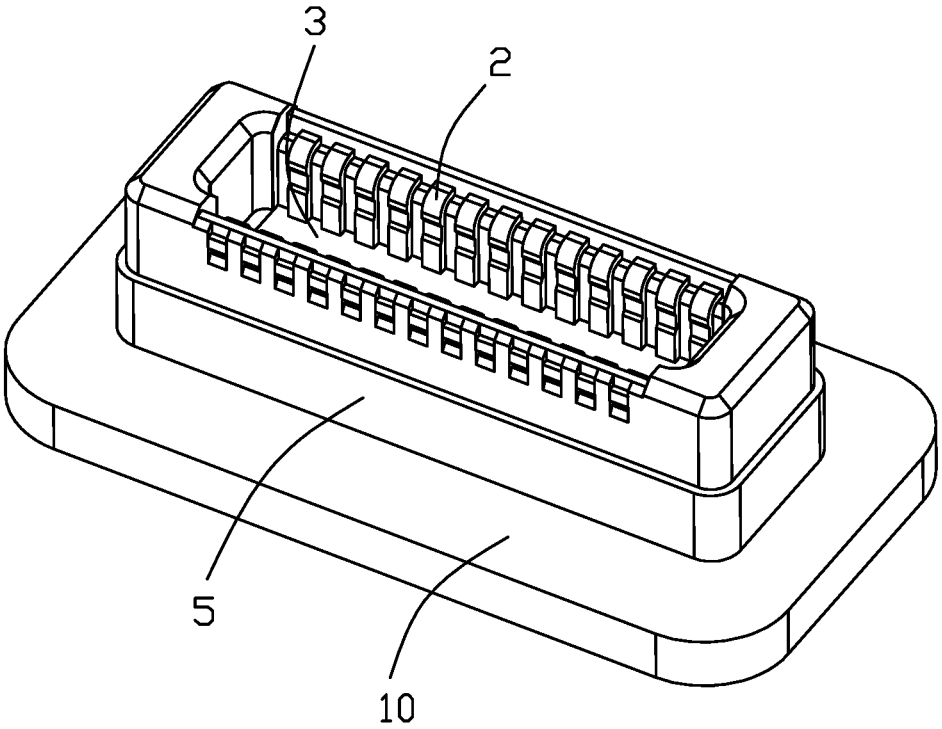
FIG. 10 is another perspective view of the hermetic electrical adaptor of FIG. 9 to show the inside glue.
Figure 11:
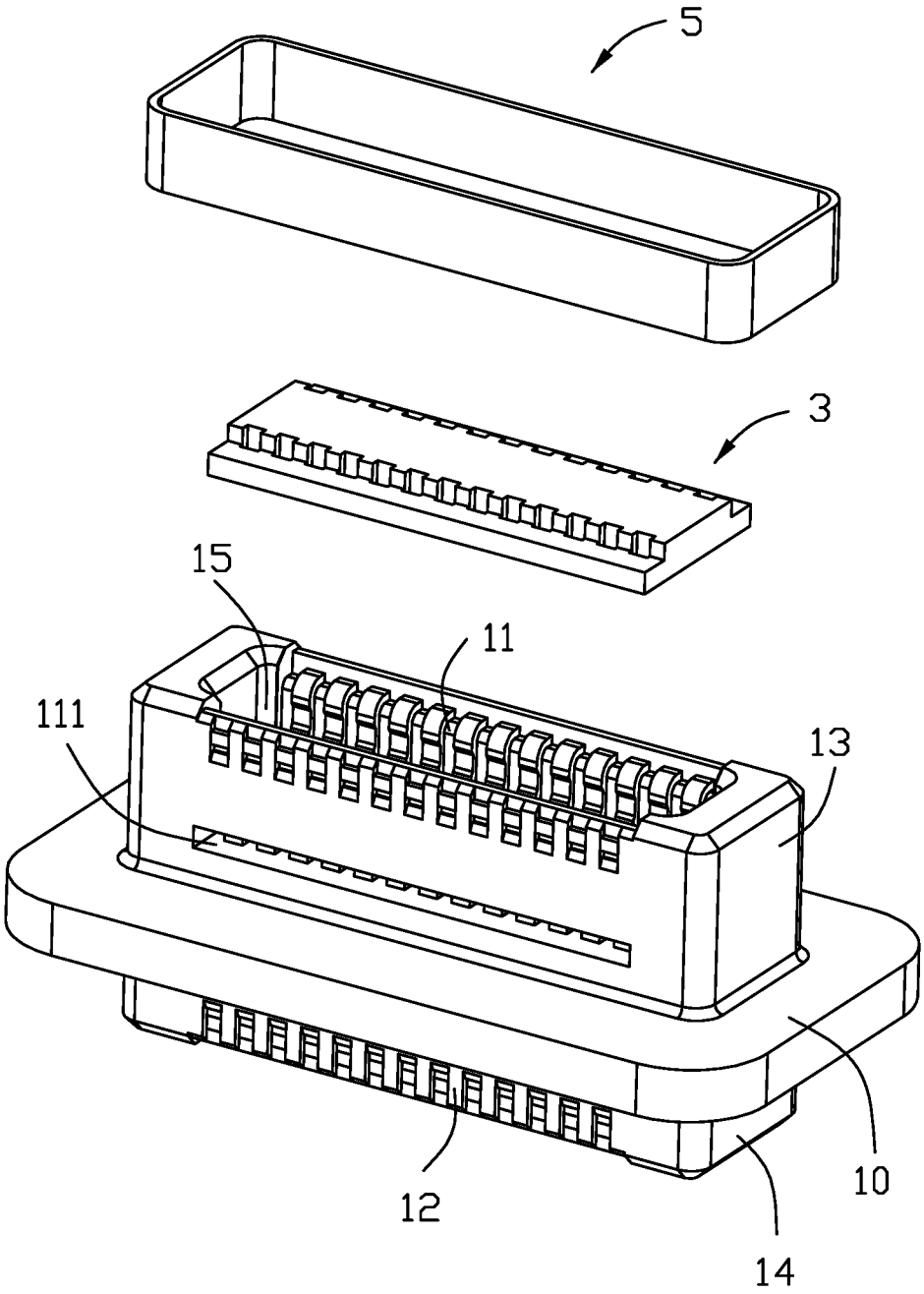
FIG. 11 is an exploded perspective view of the hermetic electrical adaptor of FIG. 9.

Referring FIGS. 9-11, the covering device 5 is a frame structure so as to surround both the set of first side walls 11 and the first end walls 13 so as to shield the first recess 111 for preventing contamination of the glue 3 upon the housing.

Figure 12:
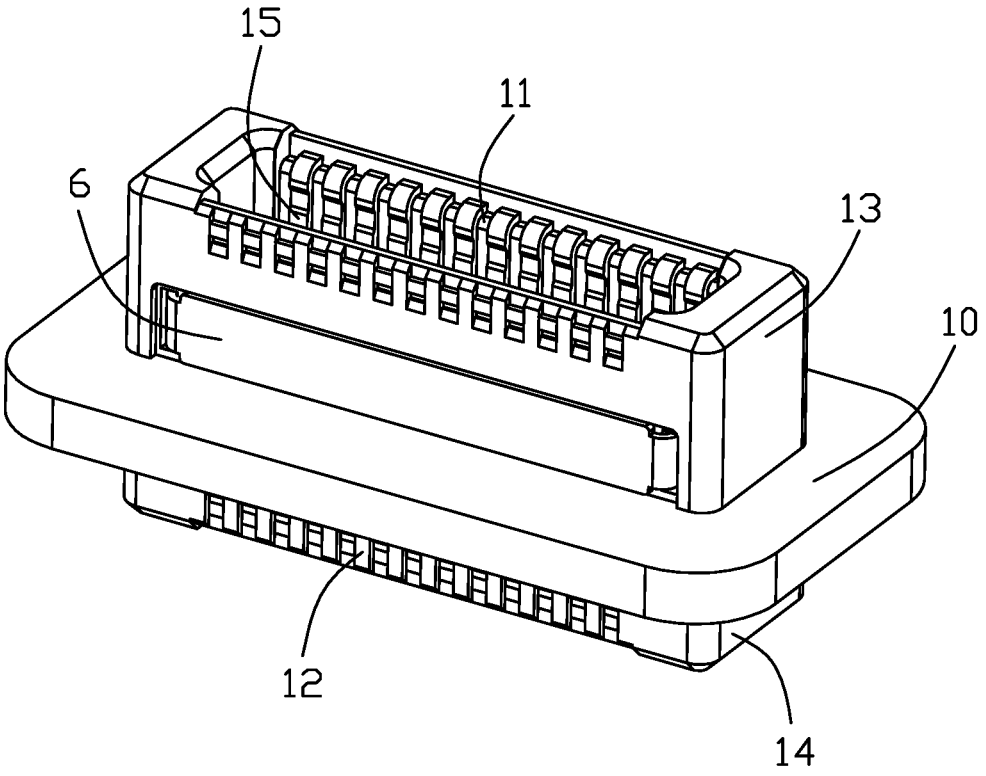
FIG. 12 is a perspective view of the hermetic electrical adaptor according to a third embodiment of the invention.
Figure 13:
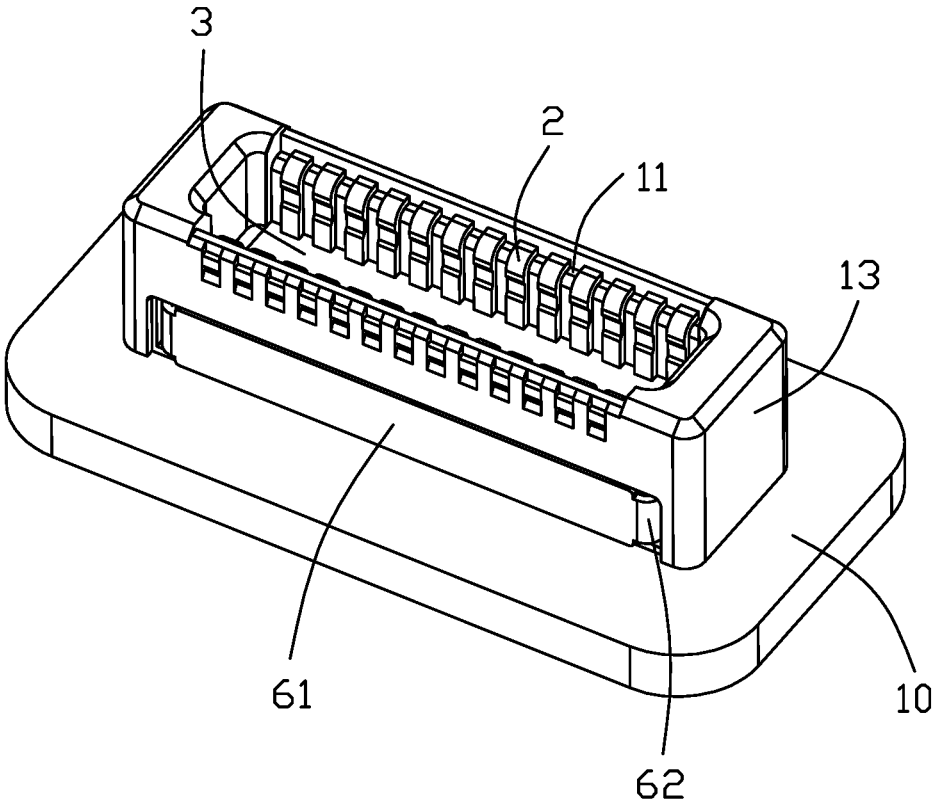
FIG. 13 is another perspective view of the hermetic electrical adaptor of FIG. 12 to show the inside glue.
Figure 14:
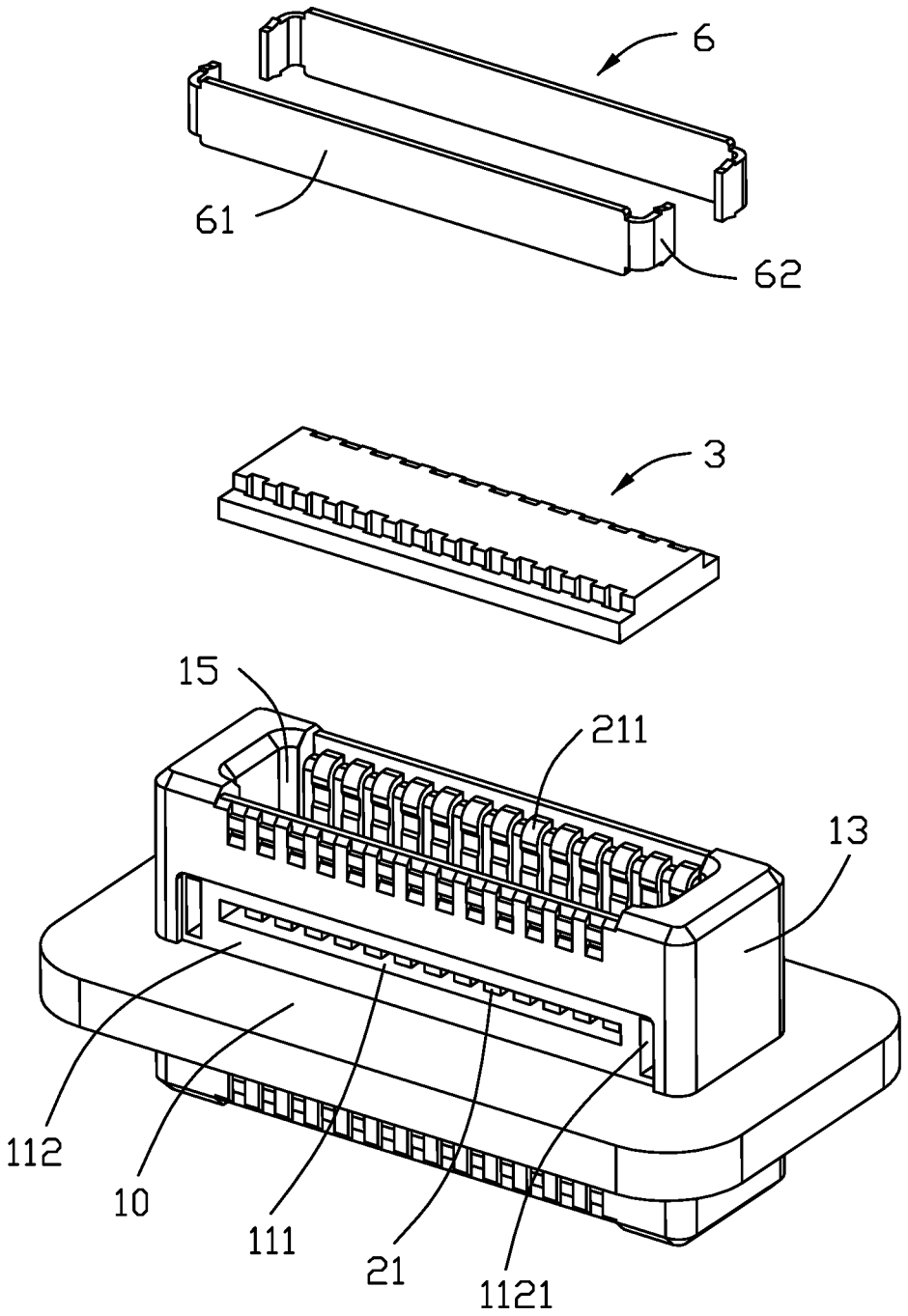
FIG. 14 is an exploded perspective view of the hermetic electrical adaptor of FIG. 12.

Referring to FIGS. 12-14, the covering device 6 forms a hook at either end of the strap wherein the covering device 6 includes a plate 61 and a pair of hooks 62 at two opposite ends. Correspondingly, the set of first side walls 11 form a shallow groove 112 communicating with the first recess 111, and a retention slot 1121 communicating with the shallow groove 112 so as to have the plate 61 received within the shallow groove 112, and the hooks 62 received within the corresponding retention slots 1121.

Figure 15:
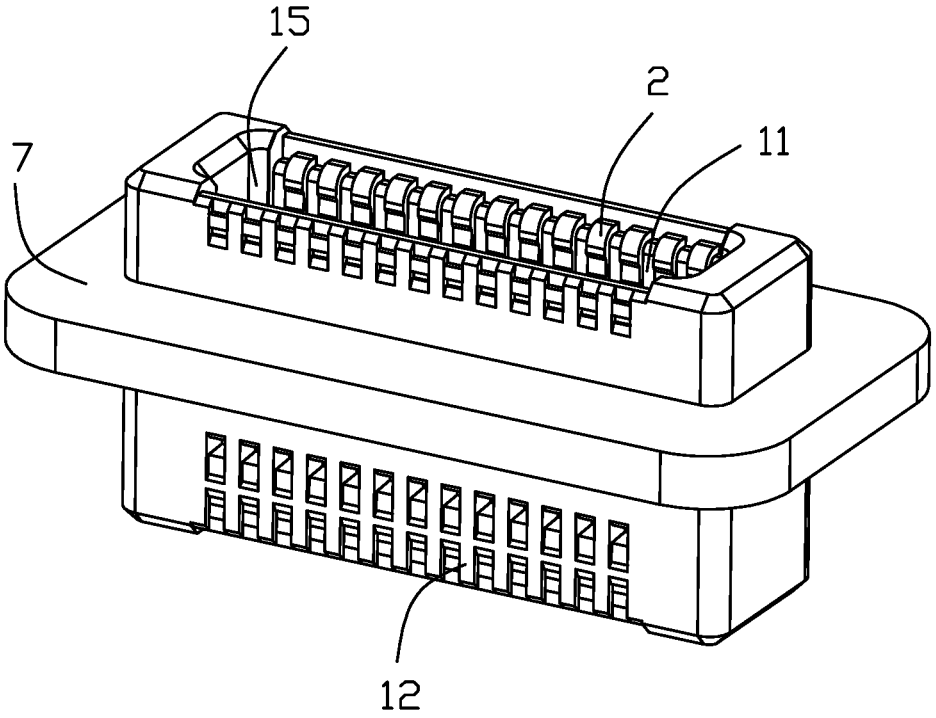
FIG. 15 is a perspective view of the hermetic electrical adaptor according to a fourth embodiment of the invention.
Figure 16:
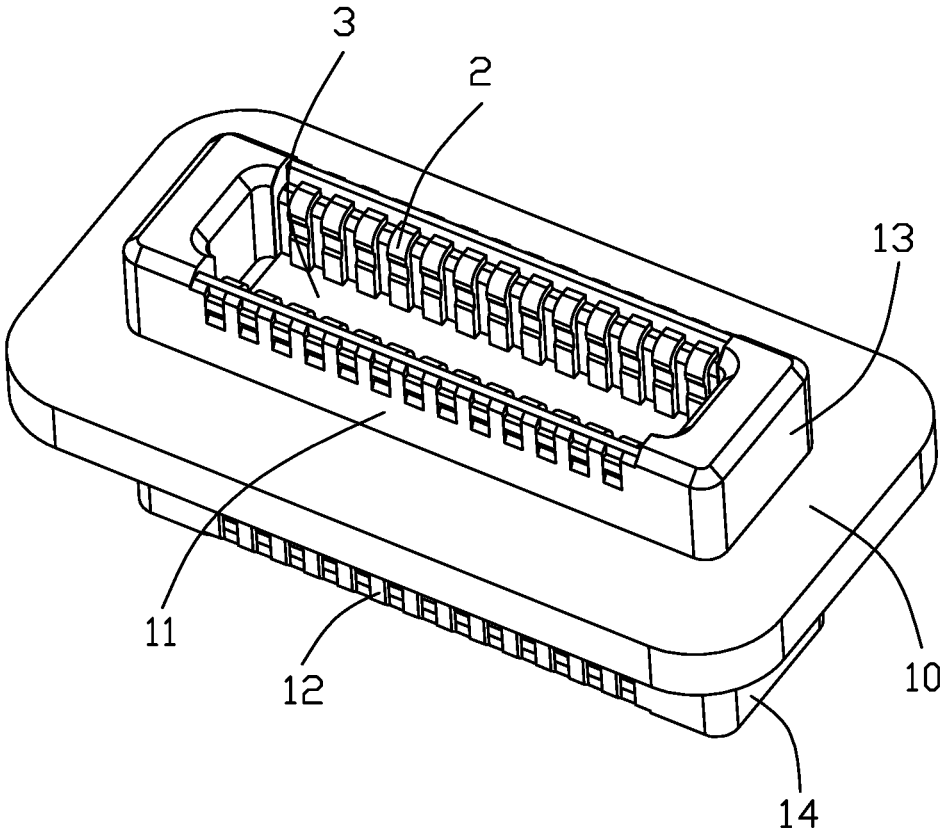
FIG. 16 is another perspective view of the hermetic electrical adaptor of FIG. 15.
Figure 17:
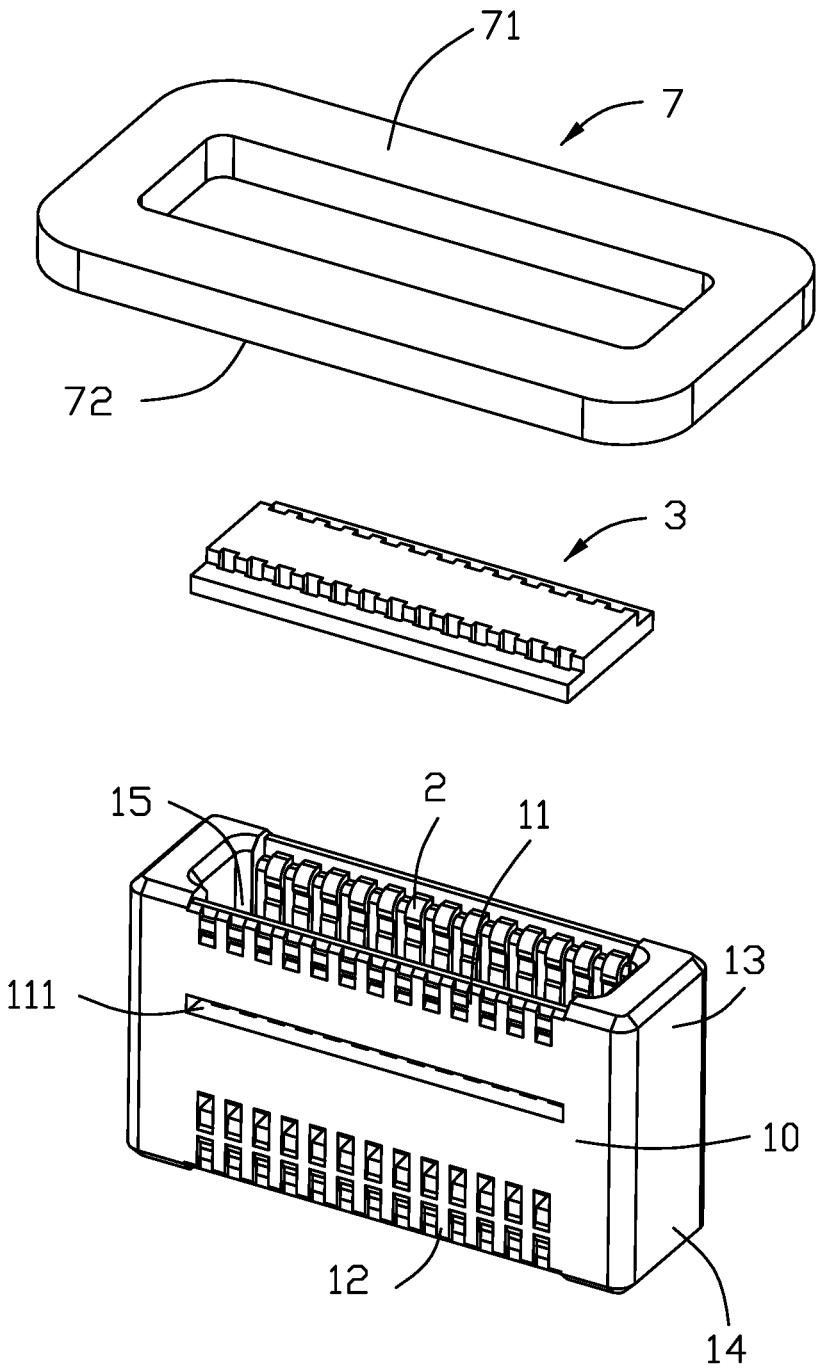
FIG. 17 is an exploded perspective view of the hermetic electrical adaptor of FIG. 16.

Referring to FIGS. 15-17, the covering device 7 is of a frame structure wherein the covering device 7 replaces the exterior part of the base on an exterior surface of the housing. In other words, the covering device 7 not only shields the first recess but also provides abutment support against the mating connector during mating. In this embodiment, the covering device 7 forms a skirt surrounding the housing with a transverse dimension similar to a width of the first mating cavity in the transverse direction.

Understandably, in the invention the upper part of the glue only covers an inner half of the half-exposed first extending section which faces toward the first mating cavity while the lower part of the glue circumferentially covers both inner half and outer half of the fully exposed first extending section.

What is claimed is:

1. A hermetical adaptor comprising:

an insulative housing including:

a base with opposite first surface and second surface in a vertical direction;

a set of first side walls extending from the first surface and away from the base in the vertical direction to form a first mating cavity;

a set of second side walls extending from the second surface and away from the base in the vertical direction to form a second mating cavity;

a plurality of contacts retained in the housing, each of said contacts including a first extending section located upon the set of first side wall and facing the first mating cavity in a transverse direction perpendicular to the vertical direction, a second extending section located upon the set of second side wall and facing the second mating cavity in the transverse direction;

a recess formed in the set of first side walls and extending therethrough in the transverse direction to communicate the first mating cavity with an exterior in said transverse direction;

a covering device attached upon the set of first side walls to shield the recess from the exterior; and a waterproofing glue occupies the recess so as to encompass an exposed portion of the first extending section therein.

2. The hermetical adaptor as claimed in claim 1, wherein the covering device is of a strap structure.

3. The hermetical adaptor as claimed in claim 1, wherein the covering device is of a frame structure.

4. The hermetical adaptor as claimed in claim 1, wherein the covering device is of a frame structure which transversely extends with a distance not less than a width of the first mating cavity in the transverse direction.

5. The hermetical adaptor as claimed in claim 1, wherein the base includes an inner part to separate the first mating cavity and the second mating cavity in the vertical direction, and an outer part transversely extending on an exterior surface of the housing in a circumferential manner.

6. The hermetical adaptor as claimed in claim 1, wherein each contact extends in a straight manner.

7. The hermetical adaptor as claimed in claim 1, wherein the covering device is of a strap structure with hooks at two opposite ends thereof.

8. The hermetical adaptor as claimed in claim 7, wherein the set of first side walls forms a shallow groove and a pair of retention slots at two ends of the shallow groove to receive the covering device.

9. The hermetical adaptor as claimed in claim 1, wherein the glue occupies a bottom portion of the first mating cavity adjacent to the first surface.

10. The hermetical adaptor as claimed in claim 9, wherein the glue in the first mating cavity is thicker than that in the recess.

11. The hermetical adaptor as claimed in claim 10, wherein the glue has an upper part only covering an inner part of the first extending section of each contact, and a lower part covering both the inner upper and an outer part of the first extending section.

12. A hermetical adaptor comprising:

an insulative housing including:

a base with opposite first surface and second surface in a vertical direction;

a set of first side walls extending from the first surface and away from the base in the vertical direction to form a first mating cavity;

a plurality of contacts retained in the housing, each of said contacts including a first extending section located upon the set of first side wall and facing the first mating cavity in a transverse direction perpendicular to the vertical direction;

a recess formed in the set of first side walls and extending therethrough in the transverse direction to communicate the first mating cavity with an exterior in the transverse direction;

a covering device attached upon the set of first side walls to shield the recess from the exterior; and a waterproofing glue occupies the recess so as to encompass an exposed portion of the first extending section therein.

13. The hermetical adaptor as claimed in claim 12, wherein each contact has a pair of bending sections at two opposite ends thereof, and said pair of bending sections extend in the transverse direction.

14. The hermetical adaptor as claimed in claim 12, wherein the glue occupies a bottom portion of the first mating cavity adjacent to the first surface.

15. The hermetical adaptor as claimed in claim 14, wherein the glue in the first mating cavity is thicker than that in the recess.

16. The hermetical adaptor as claimed in claim 15, wherein the glue has an upper part only covering an inner part of the first extending section of each contact, and a lower part covering both the inner upper and an outer part of the first extending section.

17. A method of making a hermetical adaptor comprising steps of:

providing a plurality of contacts each with a first extending section extending along a vertical direction;

integrally forming an insulative housing with said plurality of contacts via an insert-molding process, the housing including a set of first side walls forming a first mating cavity, the first extending section of the contacts located upon the set of first side wall and facing toward the first mating cavity in a transverse direction perpendicular to the vertical direction, a recess formed in the set of first side walls and extending therethrough in said transverse direction so as to communicate the first mating cavity with an exterior in the transverse direction;

attaching a covering device upon the recess to shield the recess from the exterior; and pouring a fluidal glue into the first mating cavity to fill up the recess and be solidified eventually so as to have exposed portions of the corresponding first extending sections circumferentially embedded within the glue.

18. The method as claimed in claim 17, wherein the housing forms a second mating cavity opposite to the first mating cavity in the vertical direction.

19. The method as claimed in claim 17, wherein the glue in the first mating cavity is thicker than that in the recess along the vertical direction.

20. The method as claimed in claim 17, wherein the glue has an upper part covering an inner half of each contact facing toward the first mating cavity, and a lower part covering both an inner part and an outer part of each contact circumferentially.

* * * * *